United States Patent [19]

De Rosa et al.

[11] Patent Number: 4,836,232

[45] Date of Patent: Jun. 6, 1989

[54] FOLD-UP UMBRELLA

[76] Inventors: R. James De Rosa; Gary C. Brestle, both of 20822 Sugar Loaf La., Boca Raton, Fla. 33428

[21] Appl. No.: 222,713

[22] Filed: Jul. 21, 1988

[51] Int. Cl.[4] ..... E04H 15/26; E04H 15/48; E04H 15/02

[52] U.S. Cl. ..... 135/99; 135/109; 135/118; 135/904

[58] Field of Search ..... 135/99, 101, 106, 109, 135/98, 20, 25, 118, 904; 160/351, 134, 53

[56] References Cited

U.S. PATENT DOCUMENTS

| | | | |
|---|---|---|---|
| 1,409,609 | 3/1922 | Stockle | 135/99 |
| 2,517,281 | 8/1950 | Brown | 160/134 X |
| 3,368,575 | 2/1968 | Besonen | 135/109 |
| 3,559,661 | 2/1971 | ORear | 160/134 |
| 3,604,439 | 9/1971 | Thomka | 135/109 X |
| 3,861,410 | 1/1975 | Cognet | 160/134 X |
| 4,566,475 | 1/1986 | Wund | 135/99 |

FOREIGN PATENT DOCUMENTS

| | | | |
|---|---|---|---|
| 1116379 | 11/1961 | Fed. Rep. of Germany | 135/99 |
| 1238034 | 6/1960 | France | 135/109 |
| 726646 | 3/1955 | United Kingdom | 135/99 |

*Primary Examiner*—J. Karl Bell

[57] ABSTRACT

A fold-up umbrella is disclosed as including a telescoping tubular standard centrally supporting a flexible cover made of panels arranged in a circular pattern, ribs mounted on the standard and carrying the panels, a pivoted device adjustable to spread out the ribs and panels in a pattern varying between 180° to 360°.

10 Claims, 4 Drawing Sheets

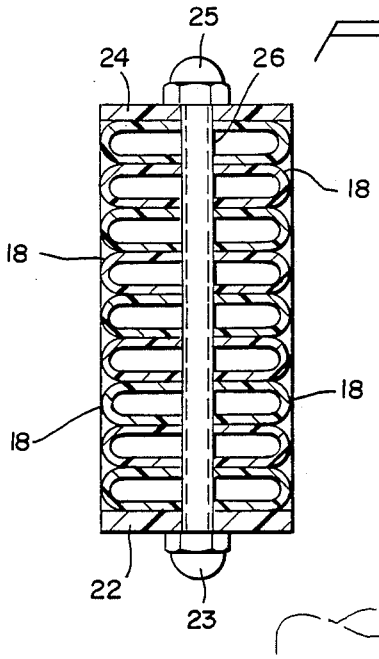
FIG 6
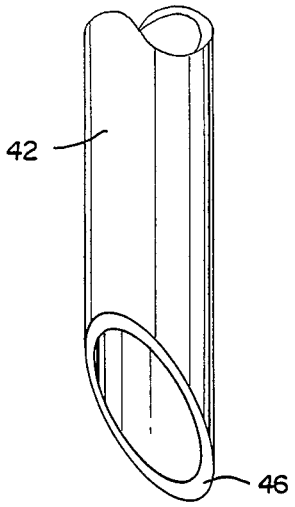
FIG 7
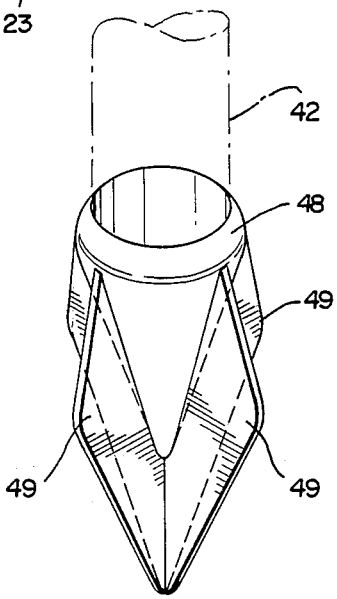
FIG 8
FIG 9
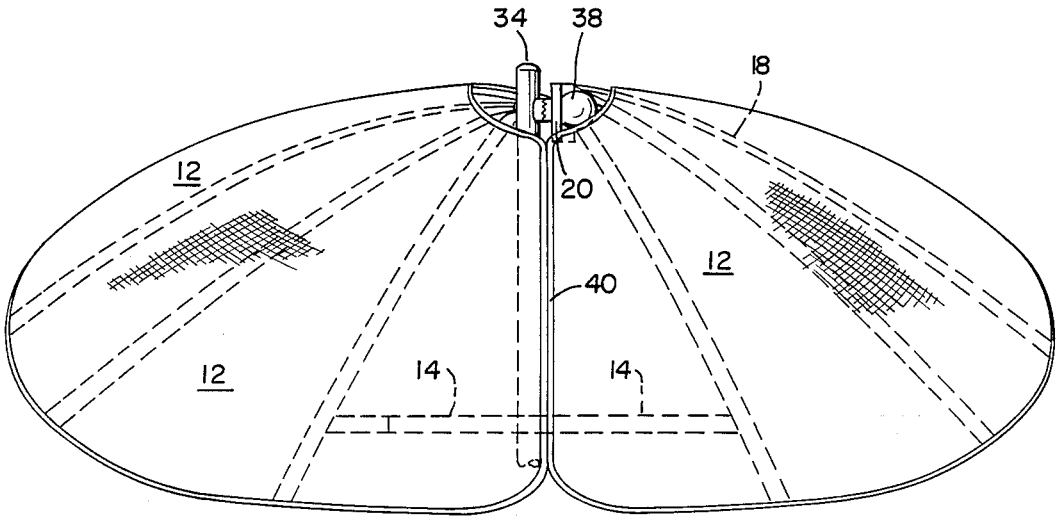

FOLD-UP UMBRELLA

BACKGROUND OF THE INVENTION

The present invention relates to a fold-up umbrella of the type having a cover mounted on ribs which are supported by a generally vertical standard.

It is an object of the present invention to construct a fold-up umbrella with a minimum of parts so as to be easily and economically manufactured.

Another object of this invention is attach the ribs of an umbrella to the cover so as to be removable and to the vertical standard in a releasably fixed manner.

The present invention has another object in that the cover of an umbrella has a portion which may be selectively opened or closed.

A further object of this invention is that an umbrella cover includes a peripheral portion defining 360° that may be lessened to present a gap in the peripheral portion.

BRIEF SUMMARY OF THE INVENTION

The present invention is summarized in that a fold-up umbrella includes a flexible cover formed from a plurality of panels arranged in a generally circular pattern, a plurality of ribs having mounting ends and opposite ends carrying the plurality of panels, a mounting block centrally disposed relative to and being attached to the mounting ends of the ribs, a central support tube having a pivot mechanism at one end secured to the mounting block for rotating the same from a fold-up position to a selected operating position, a pivotal device on the mounting block securing the mounting ends of the ribs, and an adjustment mechanism for adjusting the pivotal device whereby the ribs and panels may be spread out in the generally circular pattern. The periphery of the circular patterned panels may be varied from a 360° fully closed position to a selective lesser degrees partially opened position.

BRIEF DESCRIPTION OF THE DRAWINGS

FIG. 6 is a cross-sectional view taken along line 6—6 of FIG. 4;

FIG. 7 is an enlarged partial view of the support standard shown in FIG. 1;

FIG. 8 is a perspective view of a ground anchor mounted on the lower end of the support standard shown in FIG. 7; and FIG. 9 is a partial rear elevational view of the upper detail of FIG. 3 but showing the umbrella in a fully extended position.

DETAILED DESCRIPTION

Figure 1:
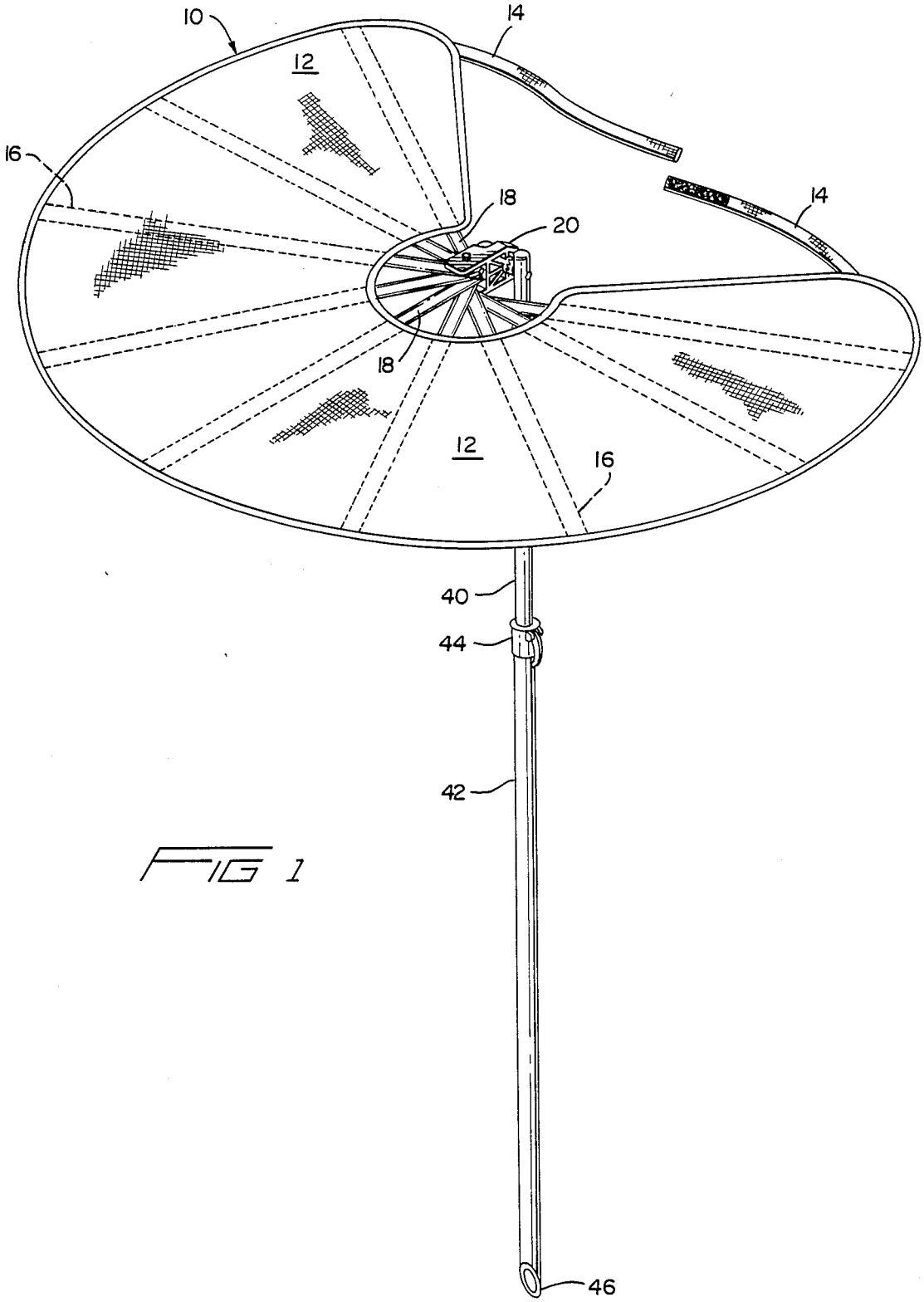
FIG. 1 is a perspective view of an umbrella embodying the present invention.
Figure 2:
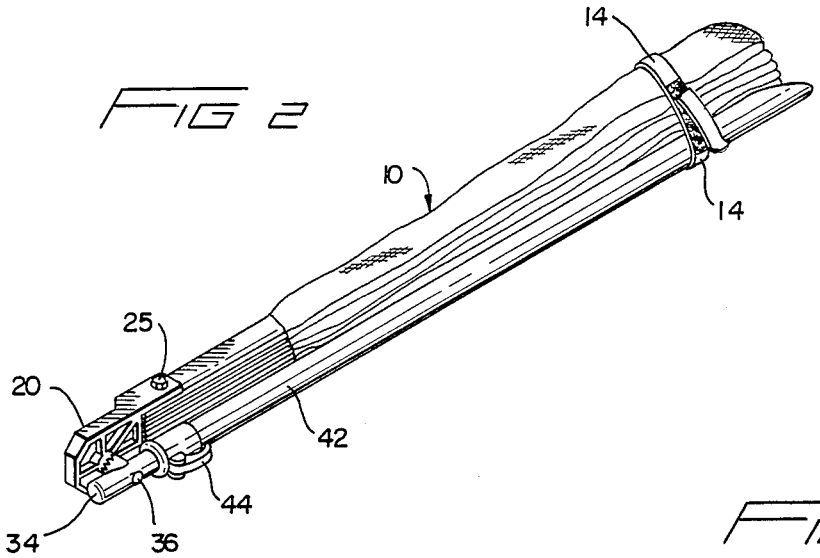
FIG. 2 is a perspective view of the umbrella of FIG. 1 but shown in a folded-up condition.
Figure 3:
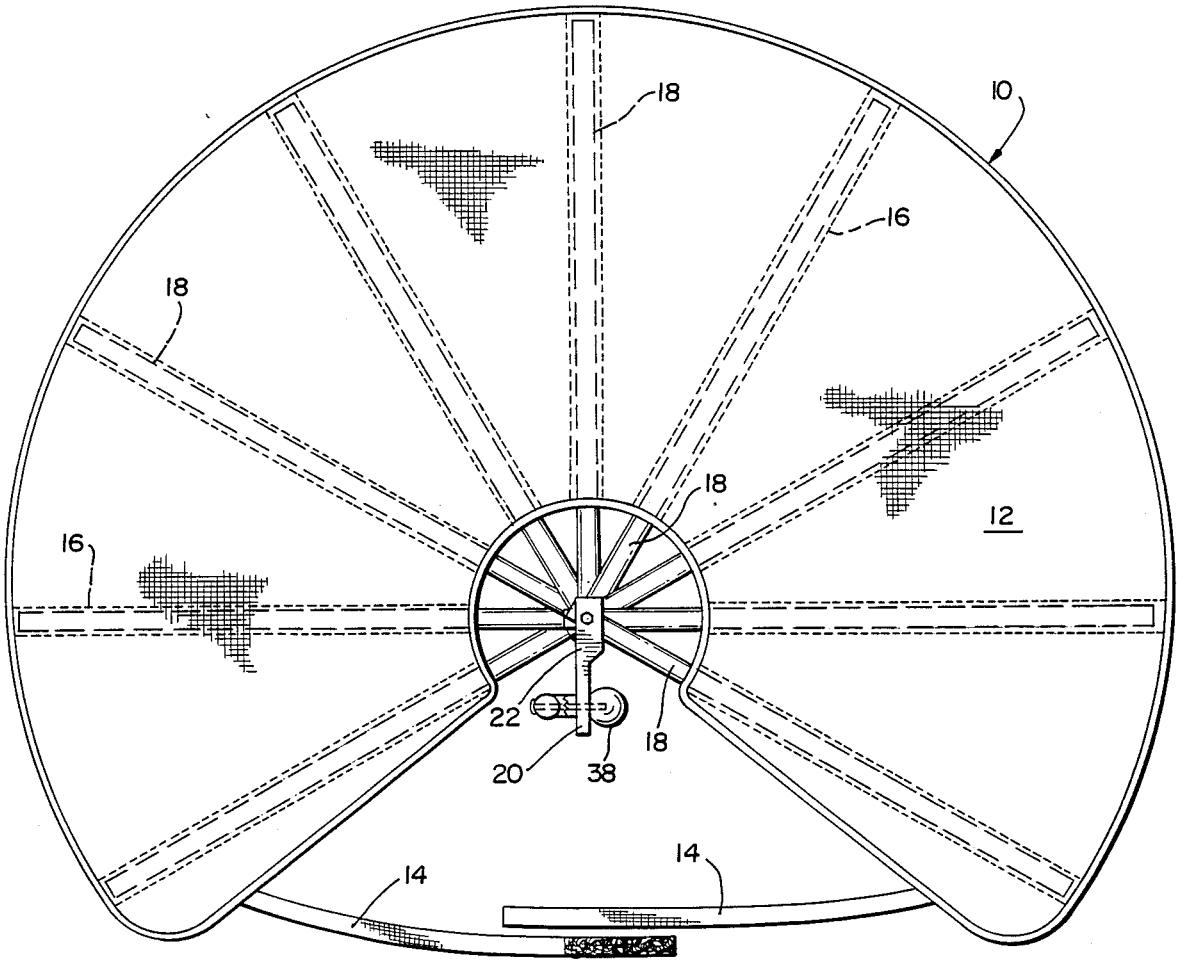
FIG. 3 is a top plan view of FIG. 1.

As is illustrated in FIGS. 1–3, the present invention is embodied in a fold-up type umbrella, indicated generally at 10, including a plurality of covering panels 12, an adjacent two of which have attachment straps 14, preferably of the Velcro type. The panels 12 are provided with a plurality of pockets 16 on their undersides as shown in FIG. 3. The pockets 16 receive a similar plurality of umbrella ribs 18 which have mounting ends that are pivotally carried by a central mount.

Figure 4:
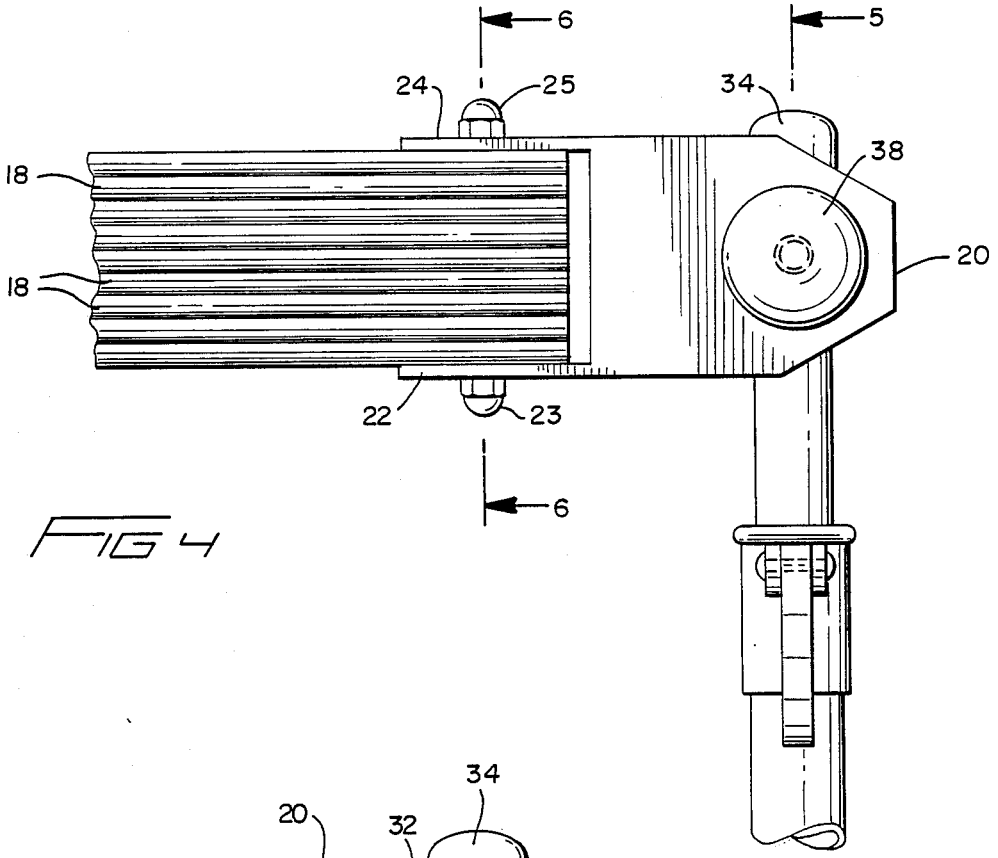
FIG. 4 is a partial side elevational view of a detail of FIG. 3.
Figure 5:
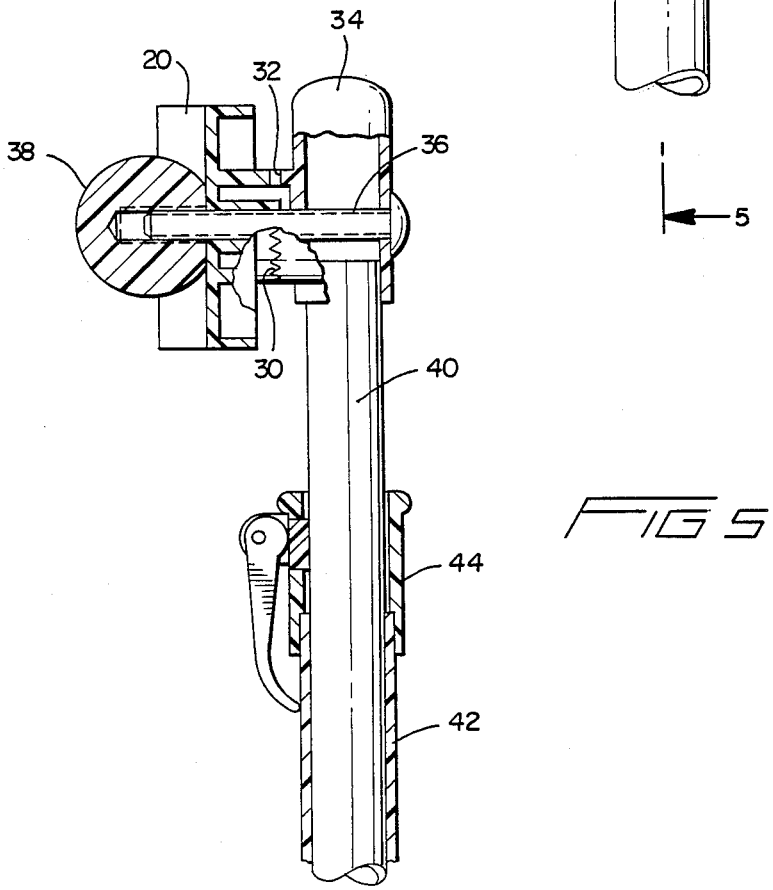
FIG. 5 a cross-sectional view taken along line 5—5 of FIG. 4.

As best shown in FIGS. 4 and 5, the central mount includes a rib support block 20 made entirely of plastic with a pair of spaced wings 22–24 between which the ends of the ribs 18 are pivotally carried on a hollow axle 26 which is retained by a pair of cap nuts 23–25 that are threaded onto the ends of the axle 26. As is shown in FIGS. 4 and 5, the mounting block 20 at its end opposite the wings 22–24 includes a circular serrated surface 30 facing a similarly serrated surface 32 formed on the exterior of a hollow cap 34. A threaded bolt 36 extends through the cap 34 with a headed end engaging the exterior of the cap 34 and the opposite portion being threaded through a similarly threaded bore in the block 20 to protrude exteriorly therefrom. A ball like operator 38 is threaded onto protruding part of the threaded bolt and is rotated to lock or unlock the serrated surfaces 30 and 32 whereby the block 20 may be positioned and locked in a fold-up position or in a selectively opened position, one or both of the cap nuts 23 and 25 may be loosen to permit rotation of the ribs 18 and panels 12 to a selected spread position.

The cap 34 is friction fitted on the top of a hollow tube 42 which telescopes into a meeting hollow tube 42. As is illustrated in FIG. 5, the relative positions between the tubes 40 and 42 may be locked in any desired position by a conventional clamping device 44.

The lowermost end of the outer tube 42 presents a tapering surface 46 (FIG. 7) which facilitates inserting the tube standard 42 into a mountable surface. For example, when using the umbrella on a mounting base (not shown) the surface 46 is easily disposed into the base opening. It should be noted that the surface 46 is also useful when disposing the standard 42 in sand or the like to act as a ground anchor.

As is illustrated in FIG. 8, a ground anchor, 48 a central hollow part receiving the end surface 46 and the lower part of tube 42; the ground anchor 48 is press fitted onto the exterior of the lower part of tube 42, but may be removed therefrom for storage or to accommodate different types of mounting surfaces. The exterior of the ground anchor 48 is provided with a plurality (4 in the illustrated example) of tapering fins 49 presenting a lance or spear like appearance.

The cover panels 12 may be made of any flexible material, such as cloth, canvas, plastic, etc.; in the present invention cloth panels were utilized.

The elements ribs 18, block 20, wings 22–24, teeth 30–32, cap 34, ball 38, tubes 40–42 and clamp 44 are all made of plastic which presents the particular advantages of light weight, low cost and ease of manufacturer. Of course, other light weight material, such as aluminum, may also be used. In the example shown in FIG. 8, the ground anchor 48 is preferably made of wood. In FIG. 5, the use of plastic eliminates the need for a journal bearing but rather permits the opening and closing of the serrated surfaces 30–32 by simply rotating the ball 38.

With the mounting ends of the ribs 18 as shown in FIG. 6 being flexible, there is no need for spacing washers and no need for a hollow journal receiving the bolt 26. The wings 22 and 24 of the block 20 are compressed toward each other by the tightening of the cap nuts on the ends of the shaft 26. This arrangement also compresses the end portions of the ribs 18 against each other whereby the umbrella panels may be locked is a selected spread position; for example, the panels 12 and ribs 18 may be spread to a variety of positions from a 180° spread to a full 360° spread, which positions are held in place by the joining of the velcro fasteners 14.

In FIGS. 1 and 3, the cover panels 12 are shown in a position leaving an opening between the adjacent panels to which the Velcro fasteners 14 are attached. Thus, the fasteners 14 aid in maintaining the gap on opening between such adjacent panels 12. When it is desired to spread the umbrella panels to a full 360° without any opening therein, the free ends of the Velcro fasteners 14 are pulled downwardly and joined together as soon as the gap is eliminated; this downward movement also causes a bow in the umbrella panels 12 as is illustrated in FIG. 9 The ends of the fasteners 14 may also be anchored to the ground as by being tied to pegs, such as tent pegs (not shown).

To fold up the umbrella from its position of FIG. 1, the cap nuts 23 and 25 are loosened and the panels 12 and ribs 18 are rotated relative to the bolt 26 so as to be on top of each other. The entire assembly of the folded panels 12 and ribs 18 with the block 20 will now be rotatable as unit about the axle 36. Upon loosening of the bolt 38, such assembly is rotated 90° from its FIG. 4 position to its fold-up position as shown in FIG. 2. The ball 38 is tightened to retain the fold-up position while the free ends of the panels 12 are held against the tube 42 by the Velcro fasteners which are wrapped around the entire assembly.

Inasmuch as the present invention is subject to many variations, modifications and changes in details, it is intended that all matter contained in the foregoing description or shown in the accompanying drawings shall be interpreted as illustrative and not in a limiting manner.

We claim:

1. A fold-up umbrella comprising a flexible cover having a plurality of panels arranged in a generally circular pattern, a plurality of ribs having mounting ends and opposite ends carrying said plurality of panels, a mounting block centrally disposed relative to and being attached to the mounting ends of said ribs, a central support tube having pivot means at one end secured to said mounting block for rotating said mounting block from a fold-up position to a selected operating position, pivotal means on said mounting block securing the mounting ends of said ribs, and means for adjusting said pivotal means whereby said ribs and panels may be spread in the generally circular pattern.

2. A fold-up umbrella as claimed in claim 1 wherein said pivotal means comprises a pair of spaced wings receiving said rib mounting ends therebetween, an axle extending through each of said rib mounting ends and said spaced wings, and said adjusting means including cap nut means threaded onto ends of said axle whereby the ribs and panels may be locked in a selected spread position.

3. An umbrella as claimed in claim 1 wherein said ribs are made of flexible plastic whereby the mounting ends thereof are compressed against each other when secured to the mounting block.

4. An umbrella as claimed in claim 2 wherein said support tube is a plastic telescoping tube having one end with a tapering surface to engage a mounting means.

5. An umbrella as claimed in claim 4 wherein a ground anchor is mounted on the said one end of said telescoping tube.

6. An umbrella as claim in claim 5 wherein said ground anchor is made of wood and has plurality of tapering fins thereon.

7. A fold-up umbrella as claimed in claim 1 wherein said means for adjusting pivot means comprises serrated locking surfaces on the said one end and on said block, an axle extending between the said one end of said support tube and said mounting block, and an operator on said axle for moving said serrated surfaces between locked and unlocked positions.

8. A fold-up umbrella as claimed in claim 7 wherein said operator comprises a ball fixed to an end of said axle.

9. A fold-up umbrella as claimed in claim 6 wherein said plurality of panels have a portion thereof spaced from each other to define an opening therebetween, and fastening means on said portion adapted to be secured to each other thereby determine the size of said opening.

10. A fold-up umbrella as claimed in claim 8 wherein said fastening means comprises flexible strips of Velcro fasteners, wherein said ribs and panels are folded against said support tube into a fold-up position, and said flexible strips are wrapped around the ribs, panels and support tube to retain them in the fold-up position.

* * * * *